US006983823B1

(12) United States Patent
Zumbrunnen

(10) Patent No.: US 6,983,823 B1
(45) Date of Patent: Jan. 10, 2006

(54) BOARDING LADDER AND SLIDE SYSTEM

(76) Inventor: Peggy A. Zumbrunnen, 7326 Walmer, Overland Park, KS (US) 66204

( * ) Notice: Subject to any disclaimer, the term of this patent is extended or adjusted under 35 U.S.C. 154(b) by 0 days.

(21) Appl. No.: 10/436,168

(22) Filed: May 12, 2003

(51) Int. Cl.
*E06C 1/00* (2006.01)

(52) U.S. Cl. ..... 182/49; 114/362

(58) Field of Classification Search ..... 182/93, 182/97, 196, 48, 49; 114/362; 14/71.1
See application file for complete search history.

(56) References Cited

U.S. PATENT DOCUMENTS

| | | | | | |
|---|---|---|---|---|---|
| 2,708,543 | A | * | 5/1955 | Matich | 182/196 |
| 3,134,999 | A | * | 6/1964 | Reynolds | 14/71.1 |
| 3,891,053 | A | * | 6/1975 | Burton | 182/97 |
| 4,243,120 | A | | 1/1981 | Pratt, Jr. et al. | |
| 4,572,330 | A | | 2/1986 | Langevin | |
| 4,630,709 | A | * | 12/1986 | Taylor | 182/48 |
| 4,989,691 | A | | 2/1991 | Wilkerson et al. | |
| 5,113,782 | A | | 5/1992 | McCarty | |
| D334,731 | S | | 4/1993 | McCarty | |
| 5,537,949 | A | | 7/1996 | Blevins et al. | |
| 5,628,274 | A | * | 5/1997 | Biedenweg et al. | 114/362 |
| 5,829,380 | A | * | 11/1998 | Smith | 114/362 |
| 5,896,946 | A | | 4/1999 | Brackett | |
| 6,119,634 | A | | 9/2000 | Myrick | |
| 6,145,621 | A | | 11/2000 | Nye | |

* cited by examiner

*Primary Examiner*—Alvin Chin-Shue
(74) *Attorney, Agent, or Firm*—Shughart Thomson & Kilroy; Marcia J. Rodgers

(57) ABSTRACT

A combination boarding ladder and slide system includes a slide having an upper end pivotally coupled with a support structure, a lower end coupled with a ramp, and a slide bed supporting a removable boarding ladder. The boarding ladder is constructed of a flexible web with generally parallel spaced apart rungs and may be folded or rolled from the slide bed to permit use of the slide. The ramp is equipped with a series of generally parallel, spaced apart rungs. the angle of inclination of the boarding ladder and ramp are preselected to provide boarding access to the support structure by an animal such as a dog. A brace extends between the slide and the support structure to maintain the slide at a preselected angle of inclination. In aquatic applications, floats may be coupled with the lower end of the slide and the ramp may extend below the surface of a body of water.

1 Claim, 2 Drawing Sheets

BOARDING LADDER AND SLIDE SYSTEM

BACKGROUND OF THE INVENTION

The present invention is concerned with a combination boarding ladder and slide adapted for use by pets as well as people. More particularly, it is concerned with a system having a slide with a removable bed ladder and a ramp with treads.

Boarding ladders are commonly employed to provide vertical access via a series of rungs or steps. When used in association with watercraft, boarding ladders permit swimmers and divers to board the craft directly from the water. While such ladders generally provide suitable access for people, they are not particularly well-suited for use by animals such as dogs. Because dogs are quadrupeds with generally horizontal spines, they are not well adapted for the upright climbing movements necessary to ascend a ladder. In addition, because dog paws are much shorter in length than human feet, dogs lack the ability to maintain balance on the rungs of conventional boarding ladders. Such ladders also generally include open riser type treads, which present a risk of falling for dogs. Their short paws necessitate use of closed risers with relatively shallow treads in order to prevent forward slippage between the treads.

Slides are commonly employed to provide a quick, slippery descent via a relatively gradual slope. When used in a marine environment, slides enable people and animals to descend by sliding directly into the water. However, because they are slippery and lack footholds, they do not provide corresponding boarding access.

Accordingly, there is a need for a boarding ladder that enables vertical circulation between a boat and the water for both people and pets. The boarding ladder should have a gradual slope of ascent and relatively narrow footholds suitable for dogs to climb from the water without lifting assistance. It should also be removable from the supporting structure so that it can be stowed when not in use.

SUMMARY OF THE INVENTION

The present invention is directed to a boarding ladder and slide system including a slide having an upper end pivotally coupled with a support structure, a lower end coupled with a ramp, and a slide bed supporting a removable boarding ladder. The boarding ladder is constructed of a flexible web with generally parallel spaced apart rungs and it may be folded or rolled from the slide bed when the slide is in use. The ramp is equipped with a series of generally parallel, spaced apart rungs. The angle of inclination of the boarding ladder and ramp are preselected to provide boarding access to the support structure by an animal such as a dog. A brace extends between the slide and the support structure to maintain the slide at a preselected angle of inclination. In aquatic applications, floats may be coupled with the lower end of the slide, and the ramp may extend below the surface of a body of water.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
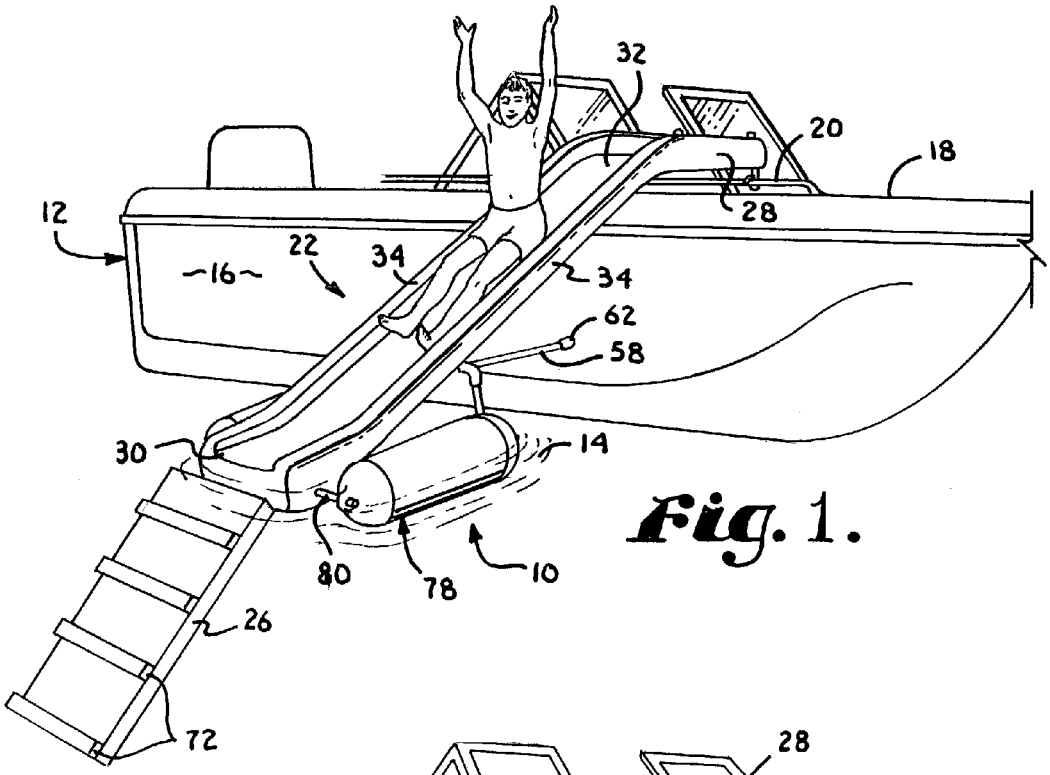
FIG. 1 is a side perspective view of a boarding ladder and slide system in accordance with the present invention showing the system coupled with a watercraft, with the boarding ladder disengaged and the slide in use.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawing figures, a boarding ladder and slide system in accordance with the present invention is generally designated by the reference numeral 10 and illustrated in FIGS. 1–5 in use in association with a boat 12 buoyantly supported by a body of water 14. The boat includes a hull 16 with gunwales 18 supporting one or more handrails 20. Those skilled in the art will appreciate that the inventive system may be employed in association with any suitable support structure, including, for example, a dock, a pier, a body of land or associated structure, and that the support structure need not be adjacent to or associated with a body of water, as, for example, a swing set or tree house. The system may also be constructed to be free-standing on a platform or pair of legs, so that no support structure is required.

The system 10 broadly includes a slide 22 coupled with a ladder 24, which may be disengaged to permit usage of the slide 22, a ramp 26 which is substantially submergible below the surface of a body of water 14, and a float assembly 27 for buoyantly supporting the slide 22 at a predetermined angle of inclination during use. In more detail, the slide 22 includes an upper end or head 28 shown removably coupled with a boat 12, a lower end or foot 30 removably coupled with a ramp 26 and an elongated slide bed 32 extending between the ends. A pair of upstanding siderails 34 extend along either side of the bed 32 to prevent a user from falling off the side of the bed 32.

The slide 22 extends at a predetermined overall angle of inclination from the horizontal and any suitable angle may be selected, although an angle of approximately 30° to about 75° is generally preferred. The slide upper end 28 includes a nearly horizontal entrance or resting area 35. In addition to the overall configuration of the slide 22 shown in FIGS. 1 and 2, the slide may have alternate overall configurations such as undulating, laterally curvate, spiral or tubular.

Figure 5:
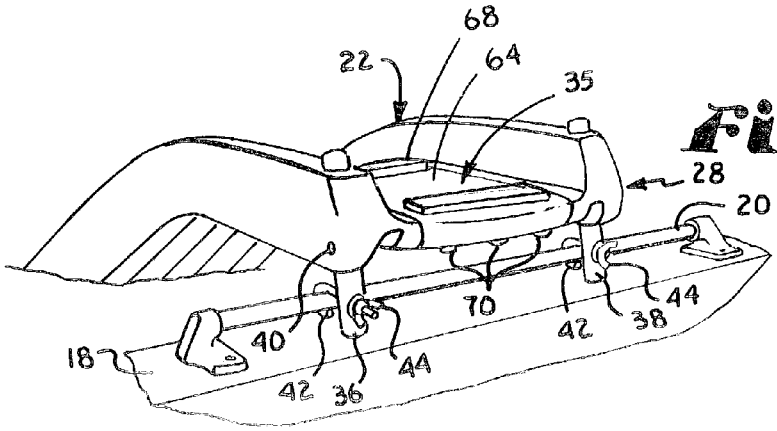
FIG. 5 is an enlarged fragmentary upper rear perspective view of the slide, illustrating the structure coupling the slide to a watercraft handrail and the boarding ladder to the slide.

As best shown in FIG. 5, a pair of vertical supports or legs 36 and 38 extend through holes or bores in the siderails 34 at the upper end 28 of the slide 22. The legs 36 and 38 are each secured against vertical movement by a generally horizontal bolt 40 (one is shown) through a respective siderail 34. The lower ends of the legs 36 and 38 are apertured front-to-back for receiving a pair of J-bolts 42 which extend through the legs 36 and 38 for pivotal coupling with the generally cylindrical handrail 20 of the boat 12. Wing nuts 44 snug the J-bolts 42 to the legs 36 and 38 and about the rail 20. While a particular pivotal coupling assembly is disclosed herein, It is anticipated that the specific hardware employed will be selected to provide pivotal coupling of the system 10 with the particular support structure 12, which may also present planar, rather than cylindrical coupling surfaces.

Figure 3:
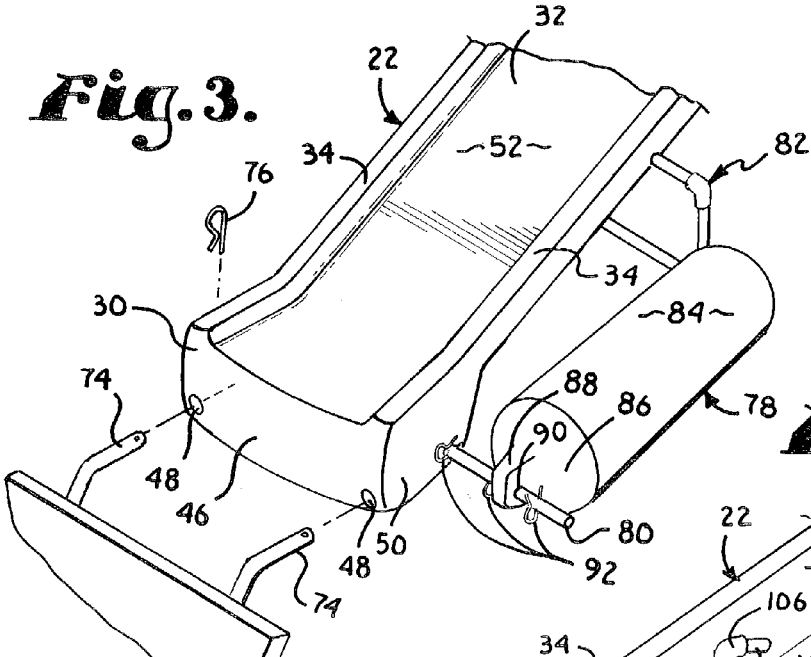
FIG. 3 is an enlarged, fragmentary, partially exploded view of the system shown in FIG. 1, showing the ramp disengaged from the slide.

As best shown in FIG. 3, the foot 30 of the slide 22 includes a generally vertical front face or kickplate 46 having a pair of laterally spaced apart apertures 48, which receive ramp-coupling structure that will be discussed subsequently in more detail. Each of the siderails 32 extends downwardly adjacent the kickplate 46 to form a pair of generally vertically oriented side supports 50.

Figure 4:
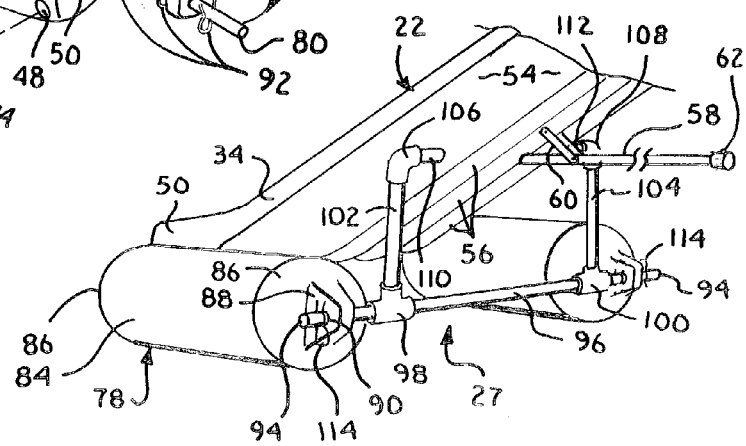
FIG. 4 is an enlarged, fragmentary lower rear perspective view of the slide depicted in FIG. 1, with the ramp removed and showing the rear portion of a float assembly mounting structure and a stand off brace in extended position.

The slide bed 32 includes a smooth, slidable upper surface 52 and a lower surface or under side 54, shown in FIGS. 4 and 5. The under side 54 includes a series of longitudinally extending molded ridges or ribs 56. The under side 54 is apertured to receive a standoff brace 58. A folding hinge 60 is used to intercouple the brace 58 with the under side 54 of the slide 22. The outwardly extending end of the brace 58 is equipped with a guard, tip or suction cup 62 to prevent damage to the hull 16 of the boat 12. The guard or suction cup 62 may also be fixedly coupled with the hull 16 and the end of the brace 58 may be secured to the cup 62 by a hook (not shown).

Figure 2:
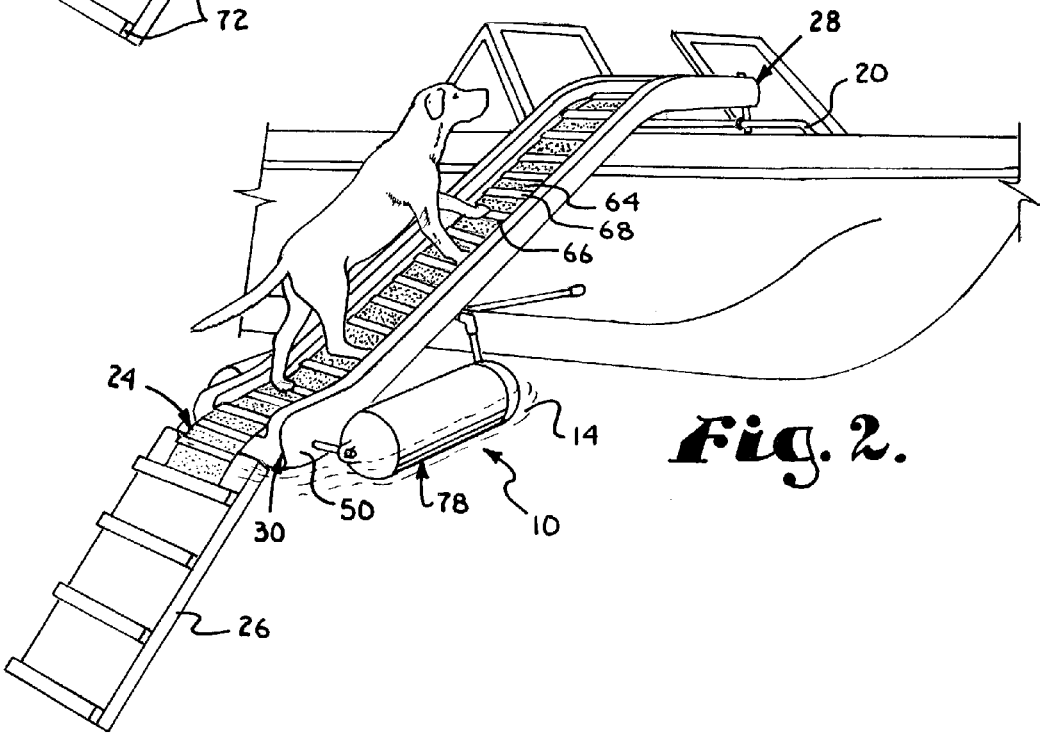
FIG. 2 is similar to the view shown in FIG. 1, showing the boarding ladder in position covering the slide bed and the ramp and boarding ladder in use by a dog.

The ladder 24 is depicted in FIGS. 2 and 5 to include a web 64 and a series of generally parallel, spaced apart sleeves 66 for receiving and holding in place a series of rungs or treads 68. The ladder 24 is sized to fit the slide bed 32, so that it extends upwardly, over the head 28 of the slide 22 for securing to the slide under side 54 with a series of spaced apart fasteners 70, such as screws, snaps, buttons or hook-and-loop type fasteners. The ladder 24 is constructed of a flexible material, such as a rubberized, synthetic resinous or natural fiber sheet or fabric to permit it to be shifted from the slide bed 32 by rolling up, and it is frictionally held in place on the slide bed 32. It may also be secured in place by installation of a series of hook and loop fasteners on the undersurface of the ladder 24 and the upper surface 52 of the slide bed 32, by hook and eye type fasteners, or by strings or ties. A continuous web 64 with sleeves 66 as depicted in FIG. 2 may be employed, or the rungs 68 may be supported on one or more spaced apart flexible rung supports, straps or chains, which may be constructed of the materials previously disclosed or of a metal or wood material. The rungs 68 may have an overall cylindrical configuration, or they may present plane surfaces such as rectangular strips. It is also foreseen that the rungs 68 may be of integral construction with the web 64, straps, or chains or that they may be secured by fasteners coupled directly with the web 64, straps, or chains, and without the use of sleeves 66. The overall construction of the ladder 24 should be sufficiently flexible to permit conformation to the shape of the slide bed 32 and to facilitate easy roll-up or removal from the bed 32 and stowing when the slide 22 is in use, but individual elements such as portions of the web 64 or rungs 68 may be of rigid construction such as wood, metal or hard plastic or heavy rubber.

The elongated ramp 26 is of generally planar construction, including a plurality of generally parallel spaced apart rungs or treads 72 on the upper surface. The rungs or treads 72 may be of integral construction with the ramp 26, or they may be secured with glue or fasteners such as nails, screws or bolts (none shown). Like the ladder rungs 68, they may have a cylindrical or planar configuration, although the latter is preferred for ease of gripping. A pair of laterally spaced apart angular support struts, pins, rods, tubes or pipes 74, are secured to the underside of one end of the ramp 26 (FIG. 3). The ends of the struts 74 are vertically apertured or bored through. They are received through the kickplate apertures 48 for securing at the back of the kickplate 46 with fasteners such as hitch pins 76.

The angle formed by the slide 22 and the ramp 26 is determined by the angular configuration of the struts 74, which have a fixed angular configuration. The angle is preselected to facilitate boarding access to the support structure 12 by a dog or other quadruped animal. In certain applications, flexible or pivotal connectors may be employed in order to allow independent movement of the ramp 26 and slide 22.

The slide 22 and ramp 26 may be constructed of wood, metal, synthetic resin or any other suitable material, and they need not be of identical construction. The slide 22 is preferably primarily constructed of synthetic resinous material such as a rotomolded polyethylene, for example as sold under the trademark Hedstrom® by Hedstrom Company, Bedford Pa. Selected portions of the slide, such as the legs 36 and 38 may be constructed of metal or other suitable material. While it is preferred that the slide 22 and ramp 26 be capable of disassembly, they may also be of unitary construction.

The float assembly 27, includes a pair of floats, pontoons or buoys 78, a front support rod or bar 80 and a rear support framework 82. The floats 78 each include a body 84 having a pair of ends 86, each having an outstanding shoulder 88 with an aperture or eye 90. The side supports 50 and ribs 56 at the foot of the slide 30 are apertured or bored through to receive the front support rod 80. The floats 78 are attached to the front support rod 80 by threading the outboard ends of the rod 80 through a respective float eye 90. The front ends of the floats 78 are secured on the front support rod in spaced relation to the side supports 50 by a series of hitch pins 92, one on either side of the shoulders 88 and one adjacent each side support 50.

The rear support framework 82 includes an elongated rear lower horizontal support rod 94 received within a coaxial support sleeve 96, a pair of spaced apart T-fittings 98 and 100 coupled with a pair of vertical supports 102 and 104 and a pair of L-fittings 106 and 108 coupled with a pair of upper horizontal supports, 110 and 112. The rear lower support rod 94 is sized to extend laterally beyond the slide 22 for mating reception of the ends within respective eyes 90 of the floats 78. The ends of the rod 94 are apertured for reception of hitch pins 114 on the outboard side of each float shoulder 88. The sleeve 96 is somewhat shorter than the rod 94 and is sized in both length and diameter to provide a stop against inboard movement of the float shoulders 88, in order to maintain the floats in generally parallel alignment with the siderails 34 of the slide 22 and to prevent encroachment of the floats 78 beneath the slide 22. Hitch pins, additional sleeves, or upsets integral with the rod 94 may also be employed as stops, either in addition to or in place of the sleeve 96. T-fittings 98 and 100 are coupled adjacent each end of the sleeve 96, for reception of the vertical support rods 102 and 104 in spaced relation to the siderails 34 of the slide 22. Where alternate stops are employed and the sleeve 96 is eliminated, the T-fittings 98 and 100 are coupled directly with the rod 94. The vertical support rods 102 and 104 are sized to support the L-fittings 106 and 108 and horizontal supports 110 and 112 for contact of the latter with the slide underside 54. The ribs 56 on the slide underside 54, are apertured to receive the upper horizontal supports 110 and 112 in generally parallel relationship with the lower support rod 94 within the sleeve 96. While an assembled rear support framework 82 has been described, the framework may also be of unitary construction.

In use, a combination boarding ladder and slide system 10 in accordance with the invention is coupled with a support structure such as a boat 12 by hooking the J-bolts 42 over a handrail 20 and tightening the wing nuts 44. The ramp 26 is coupled with the slide 22 by inserting the struts 74 into corresponding apertures 48 and attaching fasteners 76. The float assembly 27 is coupled with the slide 22 by fastening a float 78 on one side of the front support rod 80 with pins 92 on either side of the shoulders 88, sliding the rod 80 through the apertured slide side supports 50, inserting pins 92 on either side of the side supports 50 and installing the second float on the opposite side of the front support rod 80 and fastening it in place in the same manner with pins 92. The free ends of rear upper horizontal supports 110 and 112 are inserted horizontally into the apertured ribs 56 toward a midline of the slide 22 and the lower support rod 94 is threaded through the sleeve 96. The ends of the rod 94 are threaded through the eyes 90 of the respective floats 78 and fastened in place with hitch pins 114. The standoff brace 58 is pulled downwardly to a generally horizontal position until the hinge 60 locks in an open position and the tip of the brace 62 engages the hull 16 of the boat 12.

A dog or human user climbs from the deck of the boat 12 to a resting position on the slide entrance area 35 and pushes off down the slide bed surface 52 and into the water 14. A human user unrolls the ladder 24 to a slide bed-covering position. The ladder 24 is sized so that it extends beyond the foot of the slide 30 and slightly on to the ramp 26, to provide a continuous climbing surface. A dog in the water swims to the ramp, engages the rungs 72 and walks upwardly from the ramp 26 to the ladder 24 and then up to the slide entrance 35 and then onto the boat 12. Although the boarding ladder 24 is primarily designed for use by dogs and children, it may be used by adults as well. In this manner, the combination boarding ladder and slide of the invention provides a means of vertical circulation between a body of water and a boat or other support structure that can be safely used by pets as well as humans.

The slide 22 can be easily converted to use by rolling up the ladder 24 or otherwise shifting it to a slide bed-uncovering position for use of the slide and shifting the ladder 24 back into a slide bed-covering position for converting the system 10 for use of the boarding ladder 24. The ease of conversion serves to facilitate repeated use of the system 10 for both sliding and boarding. Following use, the entire apparatus 10 is easily disassembled as previously described into three parts: a slide 22, a ramp 26 and a float assembly 27, which can be stowed on the boat 12, packed onto the boat 12 or any other vehicle for travel, or placed in storage. The ladder 24 may be left in place on the slide bed 32 during transport and storage, or it may be rolled or folded. Where the ramp 26 is hingedly coupled with the slide 22, disassembly of the two for transport and/or storage is not required.

It is to be understood that while certain forms of the present invention have been illustrated and described herein, it is not to be limited to the specific forms or arrangement of parts described and shown.

What is claimed and desired to be secured by Letters Patent is as follows:

1. A combination boarding ladder and slide for coupling with a boat buoyantly supported by a body of water, comprising:

(a) a slide having an upper end with means for pivotally coupling the upper end to the boat, a lower end, said slide having a pair of walls and a bed therebetween forming a channel, the lower end of said slide being positioned to contact the body of water;

(b) a boarding ladder removably supported on said slide bed;

(c) an elongated ramp having an upper end and a lower end;

(d) said ramp upper end coupled with said slide lower end;

(e) said ramp including a plurality of generally parallel spaced apart rungs;

(f) said boarding ladder having a web intercoupling a series of generally parallel spaced apart rungs;

(g) a support coupled with said slide for supporting said slide at a preselected angle of inclination to enable a person to slide thereon in the absence of said boarding ladder; and including (h) a float coupled with said slide lower end, a stand-off brace coupled to the underside of the slide to prevent rotation of said slide lower end towards the boat.

* * * * *